US009892841B2

(12) United States Patent
Choi

(10) Patent No.: US 9,892,841 B2
(45) Date of Patent: Feb. 13, 2018

(54) INDUCTOR

(71) Applicant: SAMSUNG ELECTRO-MECHANICS CO., LTD., Suwon-Si, Gyeonggi-Do (KR)

(72) Inventor: Yu Jin Choi, Seoul (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 14/812,947

(22) Filed: Jul. 29, 2015

(65) Prior Publication Data

US 2016/0042860 A1 Feb. 11, 2016

(30) Foreign Application Priority Data

Aug. 11, 2014 (KR) ..... 10-2014-0103508

(51) Int. Cl.
*H01F 17/00* (2006.01)
*H01F 27/29* (2006.01)

(52) U.S. Cl.
CPC ..... *H01F 17/0013* (2013.01); *H01F 27/292* (2013.01); *H01F 2017/002* (2013.01)

(58) Field of Classification Search
CPC ..... H01F 27/2804; H01F 2027/2809; H01F 17/0013; H01F 5/003
USPC ..... 336/200, 223, 147, 182
See application file for complete search history.

(56) References Cited

U.S. PATENT DOCUMENTS 6,459,351 B1 * 10/2002 Maki ..... H01F 27/2804 336/200
7,375,608 B2 * 5/2008 Suzuki ..... H01F 17/0013 336/200
8,988,181 B2 * 3/2015 Chang ..... H01F 17/0013 336/200
2003/0134612 A1 * 7/2003 Nakayama ..... H01F 17/0013 455/307
2015/0228396 A1 * 8/2015 Takeda ..... H01F 17/0033 336/200

(Continued)

FOREIGN PATENT DOCUMENTS

JP H03211810 A * 9/1991 ..... H01F 17/00
JP H05101950 A * 4/1993 ..... H01F 17/00
JP H1197256 A * 4/1999 ..... H01F 17/00

(Continued)

OTHER PUBLICATIONS

JPH05101950A, Machine Translation, Apr. 1993.*
JP2010165973A, Machine Translation, Jul. 2010.*
JPH1197256A, Machine Translation, Apr. 1999.*

*Primary Examiner* — Elvin G Enad
*Assistant Examiner* — Malcolm Barnes
(74) *Attorney, Agent, or Firm* — McDermott Will & Emery LLP

(57) ABSTRACT

Disclosed herein is an inductor including a ceramic main body on which a first ceramic sheet on which a primary conductor pattern is formed and a second ceramic sheet on which a secondary conductor pattern is formed are alternately stacked; a first via passing through the second ceramic sheet and connecting the primary conductor pattern; and a second via passing through the first ceramic sheet and connecting the secondary conductor pattern, so as to reinforce an electromagnetic coupling of primary and secondary coils.

9 Claims, 5 Drawing Sheets

(56) References Cited

U.S. PATENT DOCUMENTS

2015/0332840 A1* 11/2015 Yazaki ..... H01F 27/2804
336/200

FOREIGN PATENT DOCUMENTS

JP 2010165973 A * 7/2010 ..... H01F 17/00
JP 2013-222841 A 10/2013

* cited by examiner

INDUCTOR

CROSS REFERENCE(S) TO RELATED APPLICATIONS

This application claims the benefit under 35 U.S.C. Section [120, 119, 119(e)] of Korean Patent Application Serial No. 10-2014-0103508, entitled "Inductor" filed on Aug. 11, 2014, which is hereby incorporated by reference in its entirety into this application.

BACKGROUND

1. Technical Field

The present disclosure relates to an inductor, and more particularly, to a stack type inductor.

2. Description of the Related Art

An inductor is one of important passive devices constituting an electronic circuit along with resistance and a capacitor, and is widely used as a component that is mainly mounted in a power circuit such as a DC-DC converter included in an electronic device and that removes noise or constitutes an LC resonance circuit. In particular, a demand for a stack type inductor has been recently increased owing to development of an IT technology and small-sized and thin filmed electronic devices.

Meanwhile, efficiency may be improved by greatly reducing an inductor current through a coupled array structure including primary and secondary coils that are electromagnetically coupled in the inductor. A switch operates at a low frequency, which produces an effect of reducing a switching loss as well.

In the coupled array structure, according to a coupling degree of the primary and secondary coils, magnetizing inductance and leakage inductance occur. A phase difference between the two coils is 180 degrees, and magnetic fluxes thereof are coupled, which results in an effect in that a real ripple current is 2 times higher than that of a frequency.

SUMMARY

An object of the present disclosure is to provide an inductor that further reinforces an electromagnetic coupling of primary and secondary coils and that is advantageous to miniaturization by arranging the primary and secondary coils in a same space.

Another object of the present disclosure is to provide an inductor capable of improving production efficiency by using a conductor pattern having same shaped patterns.

According to an exemplary embodiment of the present disclosure, there is provided an inductor including a primary coil and a secondary coil in a ceramic main body, wherein the primary coil and the secondary coil are configured as multilayer conductor patterns connected through vias, and the conductor pattern constituting the primary coil and the conductor pattern constituting the secondary coil are alternately stacked.

In this regard, the conductor pattern constituting the primary coil, i.e., a primary conductor pattern, is formed on a first ceramic sheet, the conductor pattern constituting the secondary coil, i.e. a secondary conductor pattern, is formed on a second ceramic sheet, a first via connecting the primary conductor pattern is configured to pass through the second ceramic sheet, and a second via connecting the secondary conductor pattern is configured to pass through the second ceramic sheet.

In addition, the inductor includes a second via hole, as a penetration point of the first via, formed point away from the secondary conductor pattern in the second ceramic sheet, and a first via hole, as a penetration point of the second via, formed in a point away from the primary conductor pattern in the first ceramic sheet.

Meanwhile, as means for minimizing the number of pattern shapes of the conductor patterns, the primary conductor patterns of odd layers have a same pattern and the primary conductor patterns of even layers have a same pattern. As a same structure, the secondary conductor patterns of odd layers have a same pattern and the secondary conductor patterns of even layers have a same pattern. Furthermore, the primary conductor patterns of odd layers and the secondary conductor patterns of even layers are symmetrical in a diagonal direction, and the primary conductor patterns of even layers and the secondary conductor patterns of odd layers are symmetrical in the diagonal direction.

BRIEF DESCRIPTION OF DRAWINGS

FIGS. 3A through 3M are plan views of first through seventh ceramic sheets included in an embodiment, in which FIG. 3A is a plan view of a third ceramic sheet in which a read pattern is formed, FIGS. 3B through 3E are plan views of a first ceramic sheet in which a primary conductor pattern is formed, FIG. 3F is a plan view of a fifth ceramic sheet in which a read pattern is formed, FIG. 3G is a plan view of a fourth ceramic sheet in which a read pattern is formed, FIGS. 3H through 3K are plan views of a second ceramic sheet in which a secondary conductor pattern is formed, FIG. 3L is a plan view of a sixth ceramic sheet in which a read pattern is formed, and finally FIG. 3M is a plan view of a seventh ceramic sheet stacked on an uppermost layer.

DESCRIPTION OF EMBODIMENT(S)

Figure 1:
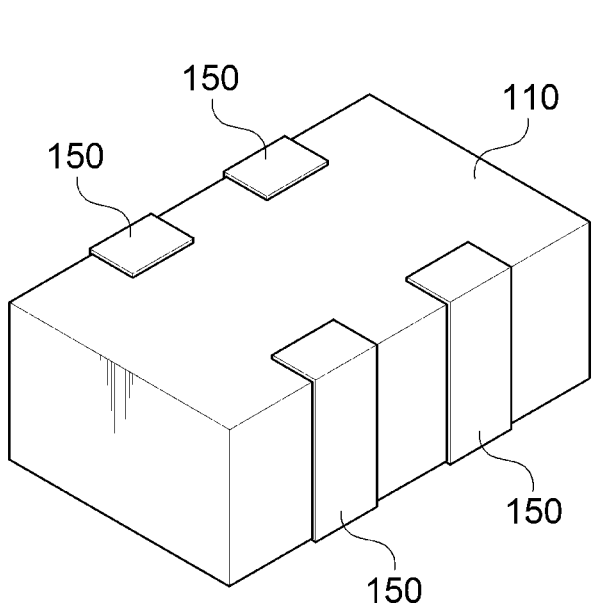
FIG. 1 is a perspective view of an inductor according to an embodiment.

Various advantages and features of the present disclosure and technologies accomplishing thereof will become apparent from the following description of exemplary embodiments described with reference to the accompanying drawings. However, the present disclosure may be modified in many different forms and it should not be limited to the embodiments set forth herein. These embodiments may be provided so that this disclosure of these embodiments will be thorough and complete, and will fully convey the scope of the disclosure to those skilled in the art.

Terms used in the present specification are for explaining the embodiments rather than limiting the present disclosure. Unless explicitly described to the contrary, a singular form includes a plural form in the present specification.

For brevity and clarity of the illustration, the drawings illustrate the general structure, and in order to avoid an unnecessarily unclear discussion of the described embodiments of the disclosure, well-known features and detailed description of the technology may be omitted. Additionally, components of the drawing's are not necessarily illustrated according to scale. For example, the size of some components of the drawings may be exaggerated compared to the other elements to aid the understanding of the embodiments of the disclosure. The same reference numerals in different drawings represent the same components.

The construction and operation effect of the present disclosure will be described in more detail with reference to the accompanying drawings below.

Figure 2:
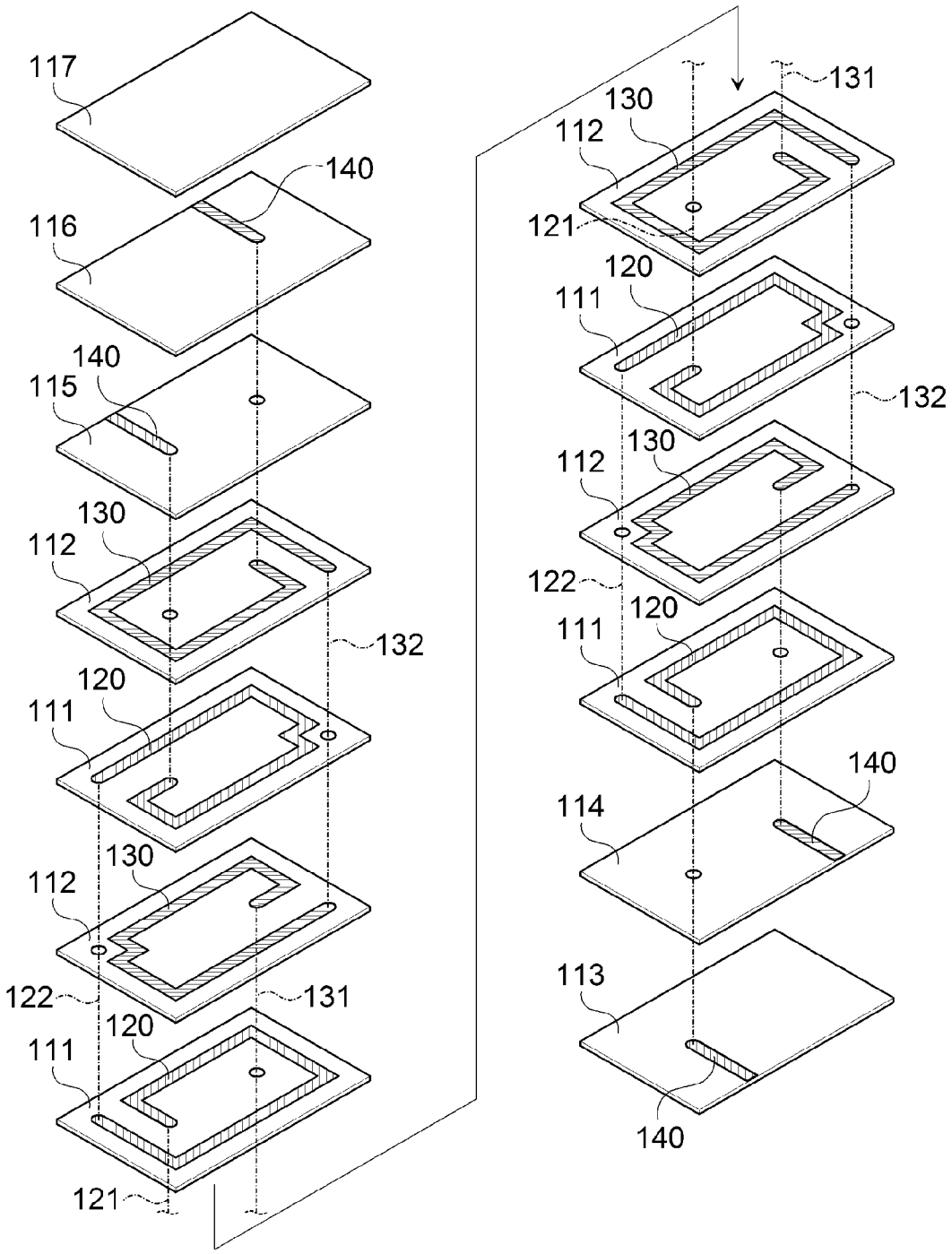
FIG. 2 is an exploded perspective view of an inductor according to an embodiment.
Figure 3A:
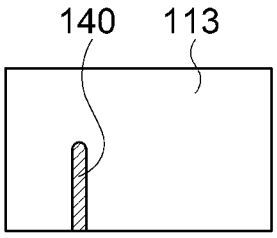

FIG. 1 is a perspective view of an inductor according to an embodiment. FIG. 2 is an exploded perspective view of an inductor according to an embodiment. FIGS. 3A through 3M are plan views of first through seventh ceramic sheets included in an embodiment, in which FIG. 3A is a plan view of a third ceramic sheet in which a read pattern is formed, FIGS. 3B through 3E are plan views of a first ceramic sheet in which a primary conductor pattern is formed, FIG. 3F is a plan view of a fifth ceramic sheet in which a read pattern is formed, FIG. 3G is a plan view of a fourth ceramic sheet in which a read pattern is formed, FIGS. 3H through 3K are plan views of a second ceramic sheet in which a secondary conductor pattern is formed, FIG. 3L is a plan view of a sixth ceramic sheet in which a read pattern is formed, and finally FIG. 3M is a plan view of a seventh ceramic sheet stacked on an uppermost layer.

Referring to FIGS. 1 through 3M, an inductor 100 according to an embodiment includes a ceramic main body 110 and a primary conductor pattern 120 and a secondary conductor pattern 130 that are included in the ceramic main body 110. For reference, although the primary conductor pattern 120 and the secondary conductor pattern 130 are formed of a same metal material, the primary conductor pattern 120 and the secondary conductor pattern 130 are distinctively illustrated for a clear description of the invention.

The ceramic main body 110 is a hexahedron formed of a ceramic material manufactured as a predetermined chip size, for example, a size corresponding to 012 (2.0 mm×1.2 mm×1.2 mm), 1005 (1.0 mm×0.5 mm×0.5 mm), 0603 (0.6 mm×0.3 mm×0.3 mm), 0402 (0.4 mm×0.2 mm×0.2mm), etc. and is completed by stacking, pressing, and sintering a plurality of ceramic sheets having a metal based ferrite such as Fe—Ni—Zn oxide, Fe—Ni—Zn—Cu oxide, or Fe, Ni, Fe—Ni(Permalloy) as a main component. Thus, adjacent ceramic sheets are integrated such that boundaries between the adjacent ceramic sheets may not be distinguished, and thus the ceramic main body 110 is formed.

In more detail, the ceramic sheet is configured as a first ceramic sheet 111 on which the primary conductor pattern 120 is formed and a second ceramic sheet 112 on which the secondary conductor pattern 130 is formed. The first ceramic sheet 111 and the second ceramic sheet 112 are alternately stacked.

The primary conductor pattern 120 and the secondary conductor pattern 130 are metal wires of a coil pattern formed of one or more materials selected from the group consisting of Ni, Al, Fe, Cu, Ti, Cr, Au, Ag, Pd, and Pt having an excellent conductivity, and may be respectively formed on the first ceramic sheet 111 and the second ceramic sheet 112 by screen printing, etc.

The primary conductor pattern 120 forms a primary coil that spirally circuits by electrically connecting each layer through a conductive via. The secondary conductor pattern 130 also forms a secondary coil by electrically connecting each layer through the conductive via.

In this regard, both ends of the primary and secondary coils are connected to a lead pattern 140 formed on a ceramic sheet for an external connection. That is, the primary conductor pattern 120 of an uppermost layer, i.e. the primary conductor pattern 120 formed on the first ceramic sheet 111 of FIG. 3E, is connected to the lead pattern 140 formed on a fifth ceramic sheet 115, and the secondary conductor pattern 130 of an uppermost layer, i.e. the secondary conductor pattern 130 formed on the second ceramic sheet 112 of FIG. 3K, is connected to the lead pattern 140 formed on a sixth ceramic sheet 116. An end of the lead pattern 140 formed on the fifth ceramic sheet 115 and the sixth ceramic sheet 116 is exposed to a side surface of the ceramic main body 110 and thus the lead pattern 140 is connected to an external terminal 150.

Figure 3B:
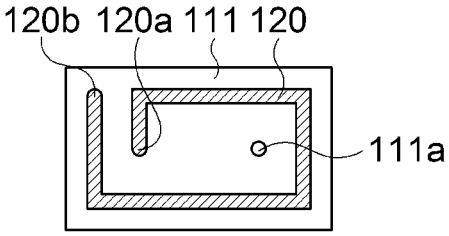
Figure 3C:
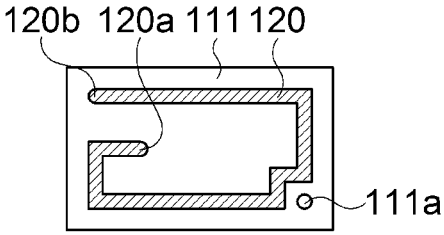
Figure 3D:
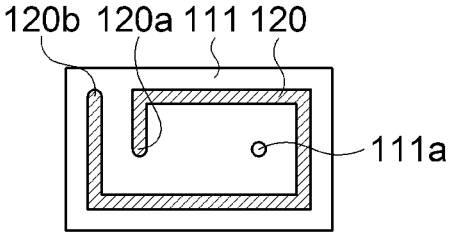
Figure 3E:
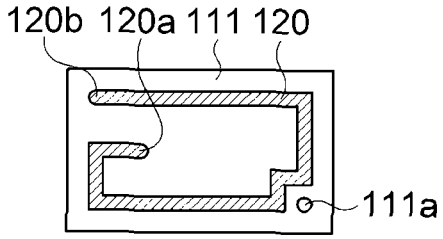
Figure 3F:
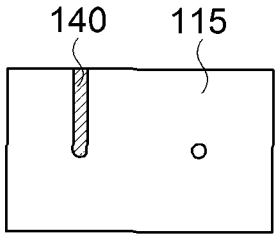
Figure 3G:
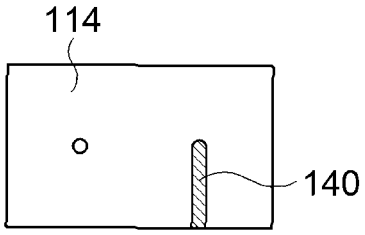
Figure 3H:
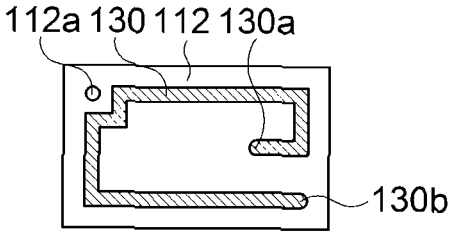

The primary conductor pattern 120 of a lowermost layer, i.e. the primary conductor pattern 120 formed on the first ceramic sheet 111 of FIG. 3B, is connected to the lead pattern 140 formed on a third ceramic sheet 113, and the secondary conductor pattern 130 of a lowermost layer, i.e. the secondary conductor pattern 130 formed on the second ceramic sheet 112 of FIG. 3H, is connected to the lead pattern 140 formed on a fourth ceramic sheet 114.

An end of the lead pattern 140 formed on the third ceramic sheet 113 and the fourth ceramic sheet 114 is also exposed to the side surface of the ceramic main body 110 and thus the lead pattern 140 is connected to the external terminal 150. Accordingly, the primary coil configured as the primary conductor pattern 120 is connected to the external terminal 150 that is an input and output end through the lead pattern 140 of the third ceramic sheet 113 and the lead pattern 140 of the fifth ceramic sheet 115 and thus the primary coil is electrically connected to the outside. Likewise, the secondary coil configured as the secondary conductor pattern 130 is also connected to the external terminal 150 that is the input and output end through the lead pattern 140 of the fourth ceramic sheet 114 and the lead pattern 140 of the sixth ceramic sheet 116 and thus the secondary coil is electrically connected to the outside.

Meanwhile, for protection from the outside, a seventh ceramic sheet 117 having no pattern may be additionally stacked on the sixth ceramic sheet 116. Although the seventh ceramic sheet 117 is formed as one layer in the present embodiment, this is merely an example. The seventh ceramic sheet 117 may be configured as multilayers and may be disposed on a lower portion of the third ceramic sheet 113.

Since the first ceramic sheet 111 and the second ceramic sheet 112 are alternately stacked, the primary conductor pattern 120 and the secondary conductor pattern 130 are also alternately stacked with the first ceramic sheet 111 or the second ceramic sheet 112 disposed therebetween. That is, the second ceramic sheet 112 on which the secondary conductor pattern 130 is formed is disposed between the primary conductor pattern 120 of an upper layer and the primary conductor pattern 120 of a lower layer, and the first ceramic sheet 111 on which the primary conductor pattern 120 is formed is disposed between the secondary conductor pattern 130 of an upper layer and the secondary conductor pattern 130 of a lower layer.

Therefore, vias connecting the primary conductor pattern 120 of each layer, i.e. first vias 121 and 122, pass through the second ceramic sheet 112 disposed between the primary conductor pattern 120 of the upper layer and the primary conductor pattern 120 of the lower layer, and vias connecting the secondary conductor pattern 130 of each layer, i.e. second vias 131 and 132, pass through the first ceramic sheet 111 disposed between the secondary conductor pattern 130 of the upper layer and the secondary conductor pattern 130 of the lower layer. For reference, the first vias 121 and 122 and the second vias 131 and 132 are illustrated as dotted lines connecting conductor patterns of each layer in FIG. 1.

A second via hole 112*a* is formed in a point of the second ceramic sheet 112 away from the second conductor pattern 130. The first vias 121 and 122 pass through the second via hole 112*a*. Accordingly, the first vias 121 and 122 do not contact the secondary conductor pattern 130 but connect only the primary conductor pattern 120 to form the primary coil. As a same structure, a first via hole 111*a* is formed in a point of the first ceramic sheet 111 away from the first conductor pattern 120. The second vias 131 and 132 pass through the first via hole 111*a*, and thus the second vias 131 and 132 do not contact the primary conductor pattern 120 but connect only the secondary conductor pattern 130 to form the secondary coil.

As described above, patterns constituting the primary coil and the secondary coil, i.e. the primary conductor pattern 120 and the secondary conductor pattern 130, are alternately disposed in a same space in the present invention, and thus a magnetic coupling characteristic is further reinforced, and a volume of entire components is greatly reduced compared to a structure in which coils are individually formed in separate spaces, thereby preferably implementing miniaturization.

The primary conductor pattern 120 and the secondary conductor pattern 130 are formed in a coil shape, and thus both ends of the primary conductor pattern 120 and the secondary conductor pattern 130 are configured as inner ends 120*a* and 130*a* close to a coil center and outer ends 120*b* and 130*b* far away from the coil center. Thus, the first vias 121 and 122 are configured as the inner via 121 connecting the inner ends 120*a* of the primary conductor pattern 120 and the outer via 122 connecting the outer ends 120*b* of the primary conductor pattern 120, and the inner via 121 and the outer via 122 change layers to connect the primary conductor pattern 120. For example, the primary conductor pattern 120 of an n layer is connected to the primary conductor pattern 120 of an n-1 layer just below the n layer through the inner via 121, and the primary conductor pattern 120 of the n-1 layer is connected to the primary conductor pattern 120 of an n-2 layer just below the n-1 layer through the outer via 122.

Likewise, the second vias 131 and 132 are configured as the inner via 131 connecting the inner ends 130*a* of the secondary conductor pattern 130 and the outer via 132 connecting the outer ends 130*b* of the secondary conductor pattern 130, and the inner via 131 and the outer via 132 change layers to connect the secondary conductor pattern 130.

According to the above structure, the via hole 112*a* through which the inner via 121 of the first via passes, for example, the via hole 112*a* formed in the second ceramic sheet 112 disposed between the primary conductor pattern 120 of the n layer and the primary conductor pattern 120 of the n-1 layer, is positioned in the inside of the secondary conductor pattern 130. The via hole 112*a* through which the outer via 122 of the first via passes, for example, the via hole 112*a* formed in the second ceramic sheet 112 disposed between the primary conductor pattern 120 of the n-1 layer and the primary conductor pattern 120 of the n-2 layer, is positioned in the outside of the secondary conductor pattern 130.

As a same structure, the via hole 111*a* through which the inner via 131 of the second via passes is positioned in the inside of the primary conductor pattern 120 in the first ceramic sheet 111. The via hole 111*a* through which the outer via 132 of the second via passes is positioned in the outside of the primary conductor pattern 120 in the first ceramic sheet 111.

As such, the inner via 121 of the first via or the inner via 131 of the second via passes through around a center potion of the second ceramic sheet 112 or the first ceramic sheet 111, and thus there is no concern that the inner via 121 of the first via or the inner via 131 of the second via contacts the secondary conductor pattern 130 or the primary conductor pattern 120. However, the outer via 122 of the first via or the outer via 132 of the second via passes through an edge of a ceramic sheet, and thus there is concern that the outer via 122 of the first via or the outer via 132 of the second via contacts the secondary conductor pattern 130 or the primary conductor pattern 120. Although there is no such concern that the outer via 122 of the first via or the outer via 132 of the second via contacts the secondary conductor pattern 130 or the primary conductor pattern 120 if a margin portion is greatly formed by reducing sizes of the primary conductor pattern 120 and the secondary conductor pattern 130 (i.e. reducing a cross section area of a coil), deterioration of inductance may not be avoided.

Therefore, the secondary conductor pattern 130 is formed to have a pattern detouring the outer via 122 of the first via in a penetration part of the first via, in more detail, in a corner part through which the outer via 122 of the first via passes. Likewise, the primary conductor pattern 120 is formed to have a pattern detouring the outer via 132 of the second via in a penetration part of the second via, in more detail, in a corner part through which the outer via 132 of the second via passes.

Such detour patterns may be formed in various shapes. For example, as shown in FIG. 3, corners of the primary conductor pattern 120 and the secondary conductor pattern 130 are curved in a stairs shape to prevent the primary conductor pattern 120 and the secondary conductor pattern 130 from contacting the outer via 122 of the first via or the outer via 132 of the second via. However, this is merely an example. Any patterns may be applicable as long as the primary conductor pattern 120 and the secondary conductor pattern 130 do not contact the outer via 122 of the first via or the outer via 132 of the second via.

As such, detour patterns are applied to a part through which the outer via 122 of the first via or the outer via 132 of the second via passes by forming the primary conductor pattern 120 and the secondary conductor pattern 130 to be larger (i.e. forming a wide cross section area of the coil) in the present invention, thereby implementing high inductance while preventing contact between the outer via 122 of the first via and the secondary conductor pattern 130 and between the outer via 132 of the second via and the primary conductor pattern 120.

Meanwhile, the primary conductor pattern 120 is partitioned as the primary conductor patterns 120 of odd layers and the primary conductor patterns 120 of even layers. The primary conductor patterns 120 of odd layers have a same pattern. The primary conductor patterns 120 of even layers have a same pattern. For example, the primary conductor patterns 120 of odd layers, i.e. the primary conductor patterns 120 formed on the first ceramic sheet 111 of FIGS. 3B and 3D, as shown in FIG. 3, have patterns starting in the inner ends 120*a* formed near the center portion of the first ceramic sheet 111 and wired along an edge of the first ceramic sheet 111 and ending in the outer ends 120*b* formed near a corner of the first ceramic sheet 111.

The primary conductor patterns 120 of even layers, i.e. the primary conductor patterns 120 formed on the first ceramic sheet 111 of FIGS. 3C and 3E have patterns starting at a point in which the primary conductor patterns 120 of odd layers end and wired along the edge of the first ceramic sheet 111 and curved in the corner part through which the outer via 132 of the second via passes in the stairs shape.

Figure 3I:
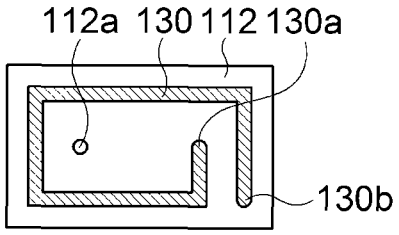
Figure 3J:
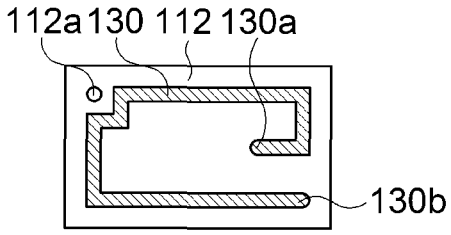
Figure 3K:
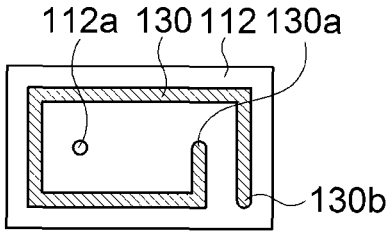
Figure 3L:
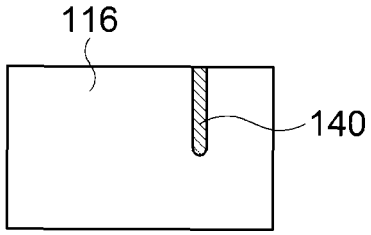
Figure 3M:
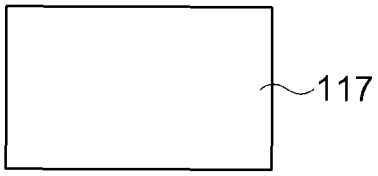

The above structure is applied to the secondary conductor pattern 130 as it is so that the secondary conductor patterns 130 of odd layers, i.e., the secondary conductor pattern 130 formed on the second ceramic sheet 112 of FIGS. 3H and 3J, have a same pattern, and the secondary conductor patterns 130 of even layers, i.e. the secondary conductor pattern 130 formed on the second ceramic sheet 112 of FIGS. 3I and 3K, have a same pattern.

In this regard, the primary conductor patterns 120 of odd layers and the secondary conductor patterns 130 of even layers are symmetrical in a diagonal direction, and the primary conductor patterns 120 of even layers and the secondary conductor patterns 130 of odd layers are symmetrical in the diagonal direction. That is, as shown in FIG. 3, the primary conductor patterns 120 of odd layers become the secondary conductor patterns 130 of even layers by rotating the primary conductor patterns 120 of odd layers by 180 degrees. Likewise, the primary conductor patterns 120 of even layers become the secondary conductor patterns 130 of odd layers by rotating the primary conductor patterns 120 of even layers by 180 degrees. Accordingly, the primary conductor patterns 120 of odd layers may be used as the secondary conductor patterns 130 of even layers as they are, and the primary conductor patterns 120 of even layers may be used as the secondary conductor pattern 130 of odd layers as they are, and thus both the primary conductor patterns 120 and the secondary conductor pattern 130 may be manufactured in two pattern shapes during manufacture, thereby greatly increasing production efficiency.

As set forth above, according to an exemplary embodiment of the present disclosure, a magnetic coupling characteristic of an inductor is further reinforced by alternately arranging respective patterns, i.e., a primary conductor pattern and a secondary conductor pattern, of a primary coil and a secondary coil in a same space. Volume of entire components may be greatly reduced compared to a structure in which the respective coils are individually formed in separate spaces, and thus the inductor is advantageous to implementing miniaturization.

As set forth above, according to an exemplary embodiment of the present disclosure, an inductor prevents a short-circuit between a primary conductor pattern and a second via and between a secondary conductor pattern and a first via by applying a detour pattern to the primary conductor pattern and the secondary conductor pattern, and simultaneously implements high inductance.

As set forth above, according to an exemplary embodiment of the present disclosure, an inductor may minimize types of conductor patterns according to pattern shapes and improve production efficiency since a primary conductor patterns of an odd layer and a secondary conductor pattern of an even layer are symmetrical to each other in a diagonal direction, and a primary conductor pattern of the even layer and a secondary conductor pattern of the odd layer are symmetrical to each other in the diagonal direction.

The detailed description described above is only to illustrate the present disclosure. Although the exemplary embodiments of the present disclosure have been described, the present disclosure may be also used in various other combinations, modifications, and environments. In other words, the present disclosure may be changed or modified within the range of concept of the disclosure disclosed in the specification, the range equivalent to the disclosure and/or the range of the technology or knowledge in the field to which the present disclosure pertains. The exemplary embodiments described above have been provided to explain the best state in carrying out the present disclosure. Therefore, they may be carried out in other states known to the field to which the present disclosure pertains in using other disclosures such as the present disclosure and also be modified in various forms required in specific application fields and usages of the disclosure. Therefore, it is to be understood that the disclosure is not limited to the disclosed embodiments. It is to be understood that other embodiments are also included within the spirit and scope of the appended claims.

What is claimed is:

1. An inductor comprising:

a ceramic main body on which first ceramic sheets and second ceramic sheets are alternately stacked, a primary conductor pattern being formed on each first ceramic sheet and a secondary conductor pattern being formed on each second ceramic sheet;

first vias passing through each interlayered second ceramic sheet, connecting the primary conductor patterns on both first ceramic sheets adjacent to the interlayered second ceramic sheet and being consisted of a first inner via(s) and a first outer via(s), the first inner via connecting inner ends of the primary conductor patterns on the both first ceramic sheets and the first outer via connecting outer ends of the primary conductor patterns on the both first ceramic sheets;

second vias passing through each interlayered first ceramic sheet, connecting the secondary conductor patterns on both second ceramic sheets adjacent to the interlayered first ceramic sheet and being consisted of a second inner via(s) and a second outer via(s), the second inner via connecting inner ends of the secondary conductor patterns on the both second ceramic sheets and the second outer via connecting outer ends of the secondary conductor patterns on the both second ceramic sheets;

external electrodes provided in a side surface(s) of the ceramic main body, first via holes formed in a point away from the primary conductor pattern in each first ceramic sheet and consisted of a first inner via hole(s) through which the second inner vias pass and a first outer via hole(s) formed on an outside area of the primary conductor pattern and through which the second outer vias pass; and second via holes formed in a point away from the secondary conductor pattern in each second ceramic sheet and consisted of a second inner via hole(s) through which the first inner vias pass and a second outer via hole(s) formed on an outside area of the secondary conductor pattern and through which the first outer vias pass, wherein the first inner via hole, the second outer via hole, the first outer via hole and the second inner via hole are arrayed in order by four ceramic sheets and the second outer via hole and the first outer via hole are located in a diagonal direction, wherein the primary conductor pattern on the interlayered first ceramic sheet through which the second outer via passes has a pattern detouring to the first via hole and the secondary conductor pattern on the interlayered second ceramic sheet through which the first outer via passes has a pattern detouring to the second via hole, and wherein the first outer via hole, disposed in the first ceramic sheet having the primary conductor pattern comprising the pattern detouring to the first via hole, and the second outer via hole, disposed in the second ceramic sheet having the second conductor pattern comprising the pattern detouring to the second via hole, are disposed diagonally from each other.

2. The inductor according to claim 1, wherein the ceramic main body further includes additional ceramic sheets on which lead patterns connected to the primary conductor pattern on the uppermost layer among the first ceramic sheets, the secondary conductor pattern on the uppermost layer among the second ceramic sheets, the primary conductor pattern on the lowermost layer among the first ceramic sheets, and the secondary conductor pattern on the lowermost layer among the second ceramic sheets, respectively, are formed to be connected with an external surface(s).

3. The inductor according to claim 1, wherein the pattern detouring to the first via hole is curved in a stairs shape in a corner part of the interlayered first ceramic sheet, and the pattern detouring to the second via hole is curved in a stairs shape in a corner part of the interlayered second ceramic sheet.

4. The inductor according to claim 1, wherein in the primary conductor pattern, the primary conductor patterns of odd layers among the first ceramic sheets have a same pattern and the primary conductor patterns of even layers among the first ceramic sheets have a same pattern.

5. The inductor according to claim 1, wherein in the secondary conductor pattern, the secondary conductor patterns of odd layers among the second ceramic sheets have a same pattern and the secondary conductor patterns of even layers among the second ceramic sheets have a same pattern.

6. The inductor according to claim 1, wherein the primary conductor patterns of odd layers among the first ceramic sheets and the secondary conductor patterns of even layers among the second ceramic sheets are symmetrical in a diagonal direction, and the primary conductor patterns of even layers among the first ceramic sheets and the secondary conductor patterns of odd layers among the second ceramic sheets are symmetrical in the diagonal direction.

7. The inductor according to claim 1, wherein the primary conductor patterns of odd layers among the first ceramic sheets have a same pattern and the primary conductor patterns of even layers among the first ceramic sheets have a same pattern, the secondary conductor patterns of odd layers among the second ceramic sheets have a same pattern and the secondary conductor patterns of even layers among the second ceramic sheets have a same pattern, and the primary conductor patterns of odd layers among the first ceramic sheets and the secondary conductor patterns of even layers among the second ceramic sheets are symmetrical in a diagonal direction, and the primary conductor patterns of even layers among the first ceramic sheets and the secondary conductor patterns of odd layers among the second ceramic sheets are symmetrical in the diagonal direction.

8. The inductor according to claim 2, wherein the additional ceramic sheets include a third ceramic sheet on which a lead pattern connected to the primary conductor pattern of the lowermost layer among the first ceramic sheets is formed, a fifth ceramic sheet on which a lead pattern connected to the primary conductor pattern of the uppermost layer among the first ceramic sheets is formed, a fourth ceramic sheet on which a lead pattern connected to the secondary conductor pattern of the lowermost layer among the second ceramic sheets is formed, and a sixth ceramic sheet on which a lead pattern connected to the secondary conductor pattern of the uppermost layer among the second ceramic sheets is formed.

9. The inductor according to claim 8, wherein the ceramic main body further includes a seventh ceramic sheet stacked on the sixth ceramic sheet.

* * * * *